US005228839A

United States Patent [19]

Peterson et al.

[11] Patent Number: 5,228,839

[45] Date of Patent: Jul. 20, 1993

[54] MULTISTAGE EJECTOR PUMP

[75] Inventors: Lester K. Peterson; Donald E. Lentz; Donald A. Bomke, all of St. Joseph, Mich.

[73] Assignee: Gast Manufacturing Corporation, Benton Harbor, Mich.

[21] Appl. No.: 705,348

[22] Filed: May 24, 1991

[51] Int. Cl.[5] ..... F04F 5/00

[52] U.S. Cl. ..... 417/174; 417/191

[58] Field of Search ..... 417/174, 170, 191, 163, 417/151, 198

[56] References Cited

U.S. PATENT DOCUMENTS

| | | | |
|---|---|---|---|
| 465,590 | 12/1891 | Burke . | |
| 984,279 | 2/1911 | Leblanc | 417/174 |
| 1,026,399 | 5/1912 | Koerting | 417/191 |
| 1,091,081 | 3/1914 | Renard | 417/174 |
| 1,135,834 | 4/1915 | Morton | 417/183 |
| 1,137,767 | 5/1915 | Leblanc | 417/174 |
| 1,180,017 | 4/1916 | Davenport | 417/170 |
| 1,195,915 | 8/1916 | Damrow . | |
| 1,423,198 | 7/1922 | Davenport . | |
| 1,491,057 | 4/1924 | Myers | 417/174 |
| 1,647,402 | 11/1927 | Eynon | 417/174 |
| 1,896,404 | 2/1933 | Hale | 417/174 |
| 2,000,762 | 5/1935 | Kraft . | |
| 2,070,562 | 2/1937 | Coyne et al. . | |
| 2,211,795 | 8/1940 | Sauer . | |
| 2,275,627 | 3/1942 | Hartmann . | |
| 2,378,425 | 6/1945 | Murray . | |
| 2,684,081 | 7/1954 | Chace | 137/517 |
| 2,836,126 | 5/1958 | Ruth . | |
| 3,064,878 | 11/1962 | Bayles et al. | 417/151 |
| 3,160,329 | 12/1964 | Radic et al. | 222/204 |
| 3,270,771 | 9/1966 | Morgan et al. | 137/525 |
| 3,445,335 | 5/1969 | Gluntz | 176/61 |
| 3,474,953 | 10/1969 | Duhaime et al. . | |
| 3,599,657 | 8/1971 | Maldavs | 137/102 |
| 3,693,656 | 9/1972 | Sauer | 137/604 |
| 3,784,325 | 1/1974 | Coanda et al. | 417/165 |
| 3,850,190 | 11/1974 | Carlson | 137/218 |
| 3,959,864 | 6/1976 | Tell | 29/156.4 |
| 3,973,588 | 8/1976 | Holst | 137/854 |
| 4,171,016 | 10/1979 | Kempton | 166/68 |
| 4,395,202 | 7/1983 | Tell | 417/169 |
| 4,400,138 | 8/1983 | Baer | 417/179 |
| 4,402,651 | 9/1983 | Ise | 417/182 |
| 4,466,778 | 8/1984 | Volkmann | 417/174 |
| 4,538,508 | 9/1985 | Ballard | 98/42 |
| 4,565,499 | 1/1986 | Greenberg | 417/174 |
| 4,597,716 | 7/1986 | Evenson | 417/181 |
| 4,610,275 | 9/1986 | Beecher | 137/854 |
| 4,696,625 | 9/1987 | Greenberg | 417/174 |
| 4,759,691 | 7/1988 | Kroupa | 417/174 |
| 4,880,358 | 11/1989 | Lasto | 417/174 |
| 4,938,665 | 7/1990 | Volkmann | 417/174 |
| 4,960,364 | 10/1990 | Tell | 417/174 |

FOREIGN PATENT DOCUMENTS

| | | | |
|---|---|---|---|
| 30001 | 9/1907 | Austria . | |
| 953280 | 11/1956 | Fed. Rep. of Germany . | |
| 1071290 | 12/1959 | Fed. Rep. of Germany . | |
| 1503706 | 7/1970 | Fed. Rep. of Germany . | |
| 361049 | 5/1906 | France . | |
| 523427 | 9/1921 | France . | |
| 842373 | 6/1939 | France . | |
| 933502 | 4/1948 | France . | |
| 975795 | 10/1950 | France . | |
| 154805 | 12/1979 | Japan | 417/163 |
| 101872 | 11/1923 | Switzerland . | |
| 339402 | 12/1930 | United Kingdom . | |

OTHER PUBLICATIONS

PCT International Publication No. WO80/02863, Tell, Dec. 24, 1980.

"Coppus Jectair ® Safe, Lightweight, High Volume Venturi Air Mover," an advertising brochure published by Coppus Engineering Corporation, Worcester, Mass., Catalog 100-Dec. 1979-15m.

*Primary Examiner*—Leonard E. Smith

*Attorney, Agent, or Firm*—Barnes & Thornburg

[57] ABSTRACT

An ejector pump having a plurality of longitudinally aligned chambers, each chamber including a pair of opposed end walls, at least two of the end walls having a nozzle and a one-way valve, with a connection to compressed gas to the most upstream of the nozzles, the pump having a single cylindrical pump body defining a cylinder or axially aligned cylinders with multiple end walls inserted therein, each wall having substantially the shape of a cross section through the cylinder or the respective cylinders. The end walls being secured to the cylinder at a point along the length of the cylinder or each end wall attached to the corresponding aligned cylinder.

15 Claims, 6 Drawing Sheets

MULTISTAGE EJECTOR PUMP

This invention relates to ejector pumps. It is disclosed in the context of ejector pumps which employ streams of compressed air to generate partial vacuums of different magnitudes, but may have utility in other fields as well.

Ejector pumps for several purposes are well known in the art. There are, for example, the ejector pumps illustrated and described in U.S. Pat. Nos.: 4,960,364; 4,938,665; 4,880,358; 4,759,691; 4,696,625; 4,597,716; 4,565,499; 4,466,778; 4,402,651; 4,400,138, 4,395,202; 4,171,016; 3,959,864; 3,784,325; 3,474,953; 3,445,335; 2,836,126; 2,378,425; 2,275,627; 2,211,795; 2,070,562; 2,000,762; 1,896,404; 1,647,402; 1,491,057; 1,423,198; 1,195,915; 1,180,017; 1,137,767; 1,135,834; 1,091,081; 1,026,399; 984,279; and, 465,590. There are also the devices illustrated in, for example PCT International Publication No. WO80/02863; Austrian Patent Specification 30001; French Patent Specifications: 975,795; 933,502; 842,373; 523,427; and, 361,049; German Patent Specifications: 1,503,706; 1,071,290; and, 953,280; Swiss Patent Specification 101,872; and United Kingdom Patent Specification 339,402. There are also the devices described in "COPPUS JECTAIR® Safe . Lightweight . High Volume Venturi Air Mover," an advertising brochure published by Coppus Engineering Corporation, 344 Park Avenue, Worcester, Mass., 01610.

Valves of several types having different applications are also known. There are, for example, the valves illustrated and described in U.S. Pat. Nos.: 4,610,275; 4,538,508; 3,973,588; 3,850,190; 3,693,656; 3,599,657; 3,270,771; 3,160,329; and 2,684,081.

According to one aspect of the invention, an ejector pump comprises a plurality of longitudinally aligned chambers. Each chamber includes a pair of opposed end walls. At least two of the walls include a nozzle and a one-way valve. Compressed gas is supplied to the most upstream of the nozzles. Expansion of the gas as it flows from the most upstream of the nozzles downstream through successive nozzles draws with it gas from each chamber, resulting in the highest magnitude partial vacuum being established in the most upstream of the chambers and successively lower magnitude partial vacuums being established in the more downstream chambers. The pump comprises a pump body defining a cylinder. Each wall has substantially the same shape as a cross section through the cylinder at a point along the length of the cylinder. Means are provided for securing each wall adjacent a respective point along the length of the cylinder.

According to another aspect of the invention, the pump body defines a plurality of axially aligned cylinders, each of which lies in open communication with an adjacent one of said cylinders. The cross-sections of the cylinders are similar. The cross-section of each such cylinder is greater in one embodiment or less in another embodiment than the cross-section of the next adjacent downstream cylinder. Each wall has substantially the same shape as a cross-section through a respective one of the cylinders. Means are provided for securing each wall in one of the cylinders.

Illustratively, the cylinder or cylinders is/are (a) circular cylinder or cylinders and the walls are circular.

Additionally, illustratively, the nozzles are oriented in the centers of their respective walls.

Further, illustratively, the one-way valves comprise disks of elastomeric material, each provided with an aperture for accommodating the nozzle provided in its respective wall. Each one-way valve further comprises one or more valve openings covered by a respective one of the disks. Each disk moves away from its respective wall to uncover the openings in its respective wall when the magnitude of the vacuum in a more upstream chamber bounded by its respective wall is not as great as the magnitude of the vacuum in a more downstream chamber bounded by its respective wall, and moving against its respective wall to cover the openings in its respective wall when the magnitude of the vacuum in a more upstream chamber bounded by its respective wall is greater than the magnitude of the vacuum in a more downstream chamber bounded by its respective wall.

Additionally, illustratively, the means for securing each wall adjacent a respective point along the length of the pump housing comprises cylindrical spacer sleeves, each having an outer cross section substantially identical to the cross-section of the cylinder to be received therein. The lengths of the sleeves are selected to provide appropriate spacing of the nozzles from each other along the length of the cylinder when the walls and sleeves are assembled therein.

Illustratively, each wall includes a perimeter. The apparatus further comprises an O-ring seal for positioning around the perimeter of each wall to seal it to the inside of its respective cylinder.

Further, illustratively, the means for securing each wall adjacent a respective point along the length of the pump housing comprises means defining grooves in the cylinders adjacent each respective point and snap rings for positioning in the grooves to capture respective walls adjacent their respective points along the lengths of the cylinders.

The invention may best be understood by referring to the following description and accompanying drawings which illustrate the invention. In the drawings.

Figure 1:
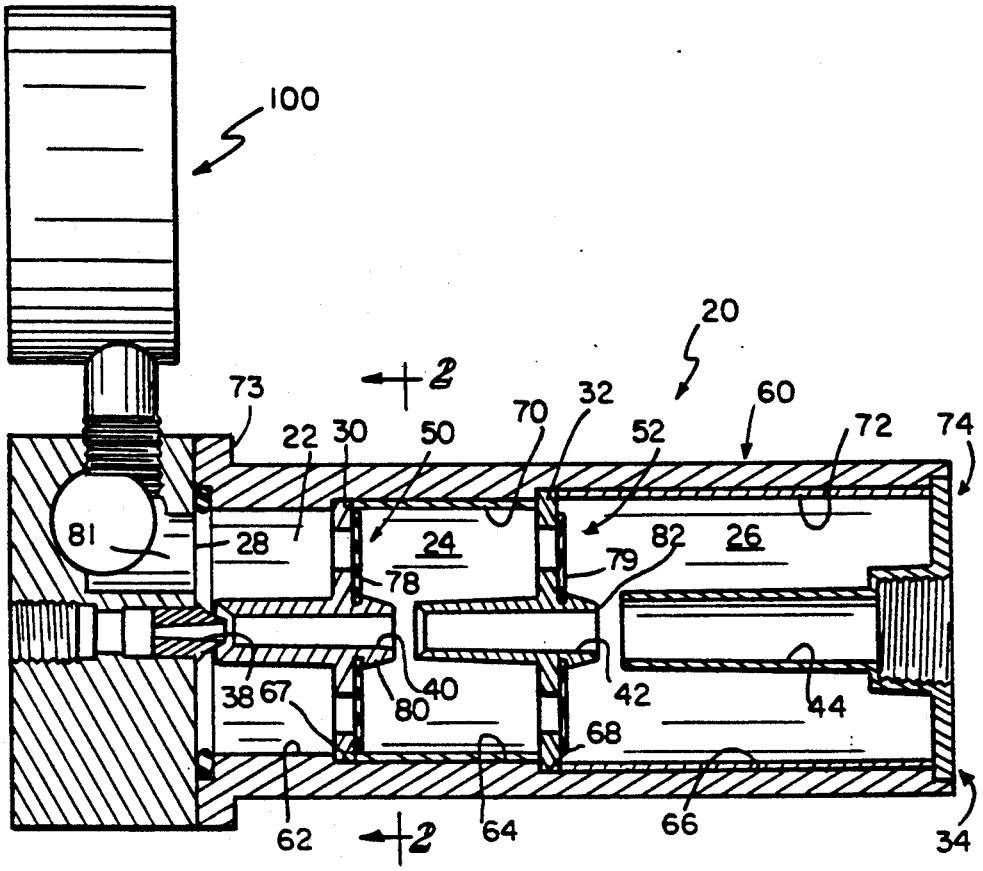
FIG. 1 illustrates a longitudinal sectional side elevational view of a device constructed according to the invention.
Figure 2:
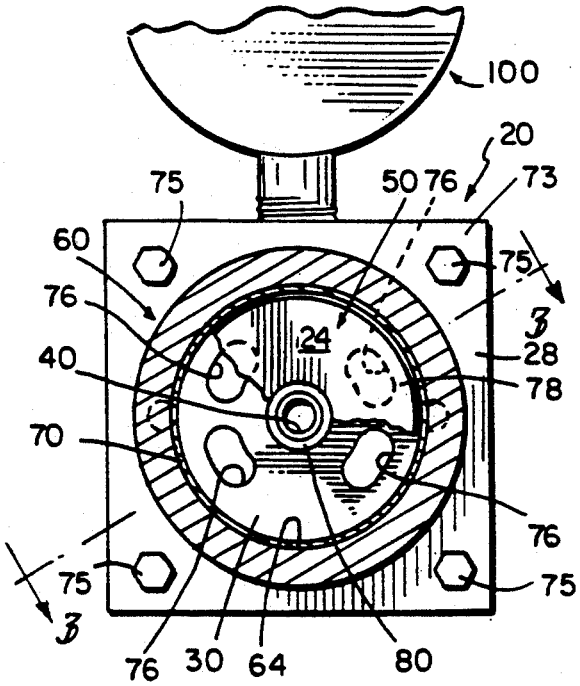
FIG. 2 illustrates a fragmentary sectional view of the device of FIG. 1 taken generally along section lines 2—2 of FIG. 1.
Figure 3:
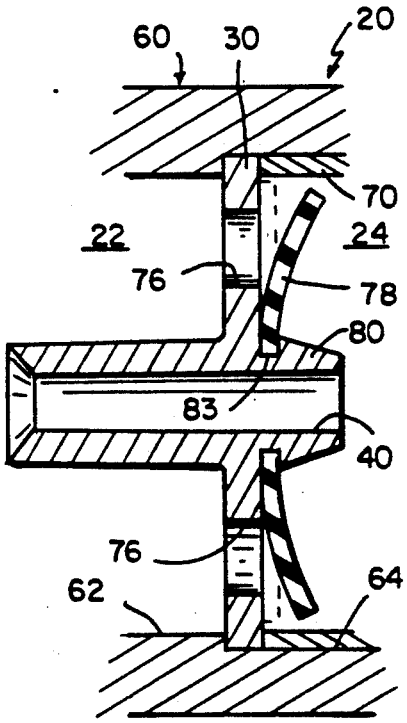
FIG. 3 illustrates an enlarged fragmentary sectional side elevational view of FIG. 1 showing a detail of the device illustrated in FIG. 1.

Turning now to FIGS. 1-3, an ejector pump 20 comprises three longitudinally aligned right circular cylindrical chambers 22, 24, 26. Each chamber 22, 24, 26 includes ends provided by: a manifold 28 and a wall 30; walls 30, 32; and walls 32, 34; respectively. Each of manifold 28 and walls 30, 32, 34 includes a nozzle 38, 40, 42, 44, respectively. Each wall 30, 32 also includes a one-way valve 50, 52, respectively. Compressed air is provided from a source, not shown through a standard pipe threaded fitting, not shown, to the first 38 of the nozzles. Nozzle 38 illustratively is a brass nozzle to be somewhat resistant to abrasion from materials carried in the compressed air flow. Such abrasion resistance is not so critical in the more downstream nozzles 40, 42, 44 because of the lower pressures encountered by them. The more downstream nozzles can be made from the same materials as the remaining parts of the pump 20 such as anodized aluminum, molded resins, and the like.

Nozzle 38 illustratively is glued into manifold 28. However, it is to be understood that the nozzle can be threaded, press-fitted, or otherwise fixed into the manifold. Each of the remaining nozzles 40, 42, 44 is designed to be carefully axially aligned with nozzle 38 along the centerline of the right circular cylindrical chambers 22, 24, 26 when pump 20 is assembled. Each nozzle 40, 42, 44 is also designed to be axially spaced from its neighbor nozzles 38, 40, 42, 44 so that expansion of the air as it flows from nozzle 38 downstream through nozzles 40, 42 and 44 and then exits from pump 20 draws air from each chamber 22, 24, 26. This creates partial vacuums in each of chambers 22, 24, 26, with the highest magnitude partial vacuum created in chamber 22, the next highest magnitude partial vacuum in chamber 24 and the third highest magnitude partial vacuum in chamber 26.

The pump 20 comprises a pump body 60 defining a plurality of axially aligned right circular cylinders 62, 64, 66, each of which lies in open communication with an adjacent one, 64, 62 and 66, 64, respectively, of the cylinders. The cross sections of all of the cylinders are similar, in this case, right circular. In this connection, it should be understood that "cylindrical," as used here, is used in its mathematical sense, that is, to define a structure generated by moving a line in a closed path parallel to another line. However, the cylinders need not necessarily be right circular cylinders. They could instead be any other suitable shape. In the embodiment of FIGS. 1-3, the cross section of cylinder 62 is slightly less than the cross section of the next adjacent downstream cylinder 64 and the cross section of cylinder 64 is slightly less than the cross section of the next adjacent downstream cylinder 66. Each wall 30, 32, 34 has a circular elevational shape. Walls 30, 32 are secured at the junctions 67, 68 of adjacent cylinders 62, 64 and 64, 66, respectively, by right circular cylindrical spacers 70, 72, respectively. Pump body 60 is provided with a square flange 73 at its end adjacent manifold 28. Pump body 60 is connected to manifold 28 by bolts 75 which extend through the flange 73 adjacent its four corners into manifold 28.

During the assembly of pump 20, wall 30 is dropped into the open end 74 of pump body 60. The perimetral region of wall 30 rests against the annular step formed at junction 67. Then, spacer 70, which has an outside diameter slightly smaller than the inside diameter of cylinder 64 is dropped into end 74. Next, wall 32 is dropped into end 74. Next, spacer 72 is dropped into end 74. Finally end 74 is closed by wall 34 which is press fitted but might equally as easily be threaded or otherwise fitted into end 74. It should be noted that the annular steps at junctions 67, 68 are so placed, and the spacers 70, 72 are of such lengths, as to provide the appropriate spacings of nozzles 38, 40, 42 and 44 from each other for optimum pump 20 performance.

Each of walls 30, 32 is provided with four perimetrally spaced valve ports 76. An elastomeric, circular elevation, valve disk 78, 79, respectively, is pressed over the portion 80, 82 of each nozzle 40, 42, respectively, that protrudes from its respective wall 30, 32 into the next adjacent downstream chamber 24, 26, respectively. The disks, 78, 79 are provided with central openings 83 for accommodating nozzle portions 80, 82. Each nozzle portion 80, 82 is provided with an annular relief or "undercut" region adjacent its respective wall 30, 32 where the disks 78, 79 snap into place and are held.

As the vacuum in chamber 22 is used, air enters chamber 22 through the high magnitude vacuum port 81 provided in manifold 28. Under certain conditions of operation, the magnitude of the vacuum in chamber 22 may tend to drop below the magnitude of the vacuum in the next adjacent downstream chamber 24. When that occurs, the disk 78 everts, as illustrated in FIG. 3, to equalize the magnitudes of the vacuums in the adjacent chambers 22, 24. In certain circumstances, a similar "inversion" of the magnitude of vacuum can also occur between chambers 24, 26. If that occurs, disk 79 everts in the same manner as illustrated in FIG. 3. The locations and configurations of the ports 76 control, to a significant extent, the way the disks 78, 79 fold as the valves 50, 52 open. Thus, the locations and configurations of the ports 76 control, to a significant extent, air flow through the valves 50, 52. The continued supply of compressed air to nozzle 38 fairly promptly reestablishes the design magnitudes of vacuum in chambers 22, 24, 26. A vacuum gauge 100 is coupled to vacuum port 81 and indicates the magnitude of the vacuum therein.

Figure 4:
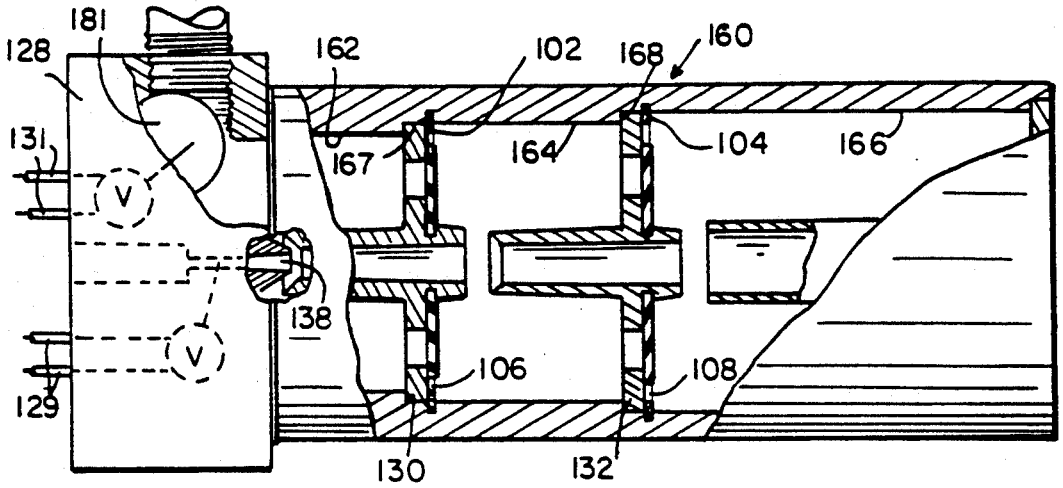
FIG. 4 illustrates a partly broken away side elevational view of another device constructed according to the present invention.

In the embodiment of the invention illustrated in FIG. 4, the spacers 70, 72 are eliminated. Instead, a pump body 160 is provided with annular grooves 102, 104 on the inner sidewalls of cylinders 164, 166, respectively, adjacent the junctions 167, 168 of adjacent cylinders 162, 164 and 164, 166, respectively. Snap rings 106, 108 snap into grooves 102, 104, respectively, to capture walls 130, 132, respectively, adjacent junctions 167, 168, respectively.

The manifold 128 of the embodiment illustrated in FIG. 4 is provided with two pairs 129, 131 of insulated electrical conductors. The conductors of pair 129 are coupled to a solenoid-actuated valve provided internally of manifold 128 which controls the flow of compressed air to the nozzle 138. The conductors of pair 131 are coupled to a solenoid-actuated valve provided internally of manifold 128 which controls the flow of compressed air to the vacuum port 181 of manifold 128. The operation of the pump 120 to create vacuum in port 181 is thus controlled by the operation of the valve controlled by current through the conductors of pair 129. The vacuum in port 181 can be quickly relieved, for example, for a so-called "blow off" operation, by operation of the valve controlled by current through the conductors of pair 131.

Figure 5:
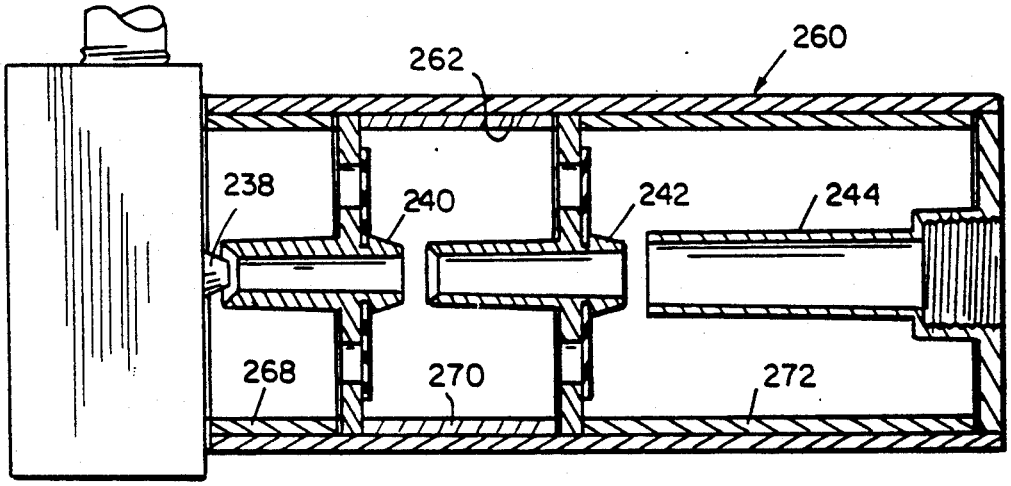
FIG. 5 illustrates a partly longitudinal sectional side elevational view of another device constructed according to the present invention.

In the embodiment of the invention illustrated in FIG. 5, the pump body 260 defines a right circular cylinder 262 of uniform cross section all along its length. The correct spacings between the adjacent surfaces of nozzles 238, 240, 242, 244 are maintained by spacers 268, 270, 272 of appropriate lengths. All of spacers 268, 270, 272 have outside diameters slightly smaller than the inside diameter of cylinder 262 to fit into it.

Figure 6:
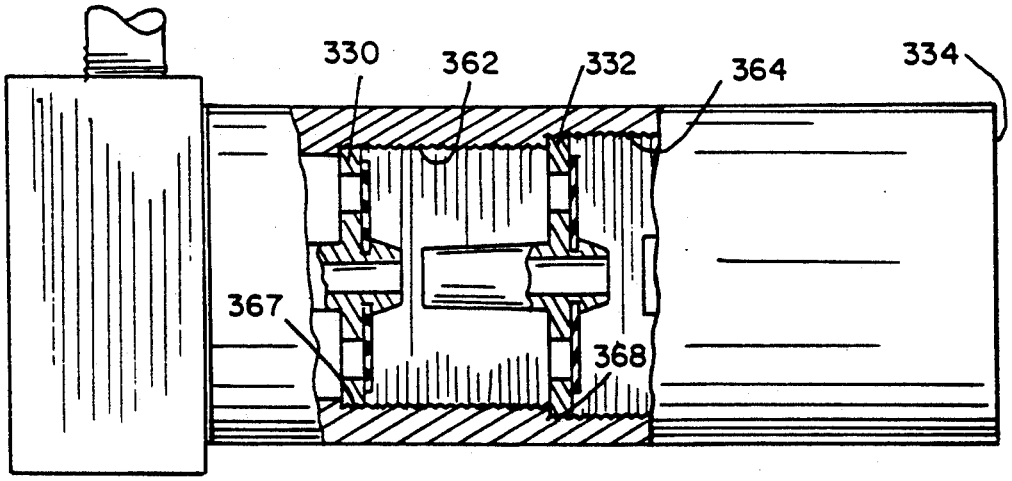
FIG. 6 illustrates a partly broken away side elevational view of another device constructed according to the present invention.

In the embodiment of the invention illustrated in FIG. 6, the inner sidewalls of adjacent cylinders 362, 364 are threaded and the perimetral edges of the walls 330, 332, 334 are provided with matching threads. Wall 330 is held in its proper position by screwing it into cylinder 362 until it reaches junction 367. Wall 332 is then screwed into cylinder 364 until it reaches junction 368. Wall 334 is screwed on to close the end of cylinder 364.

Figure 7:
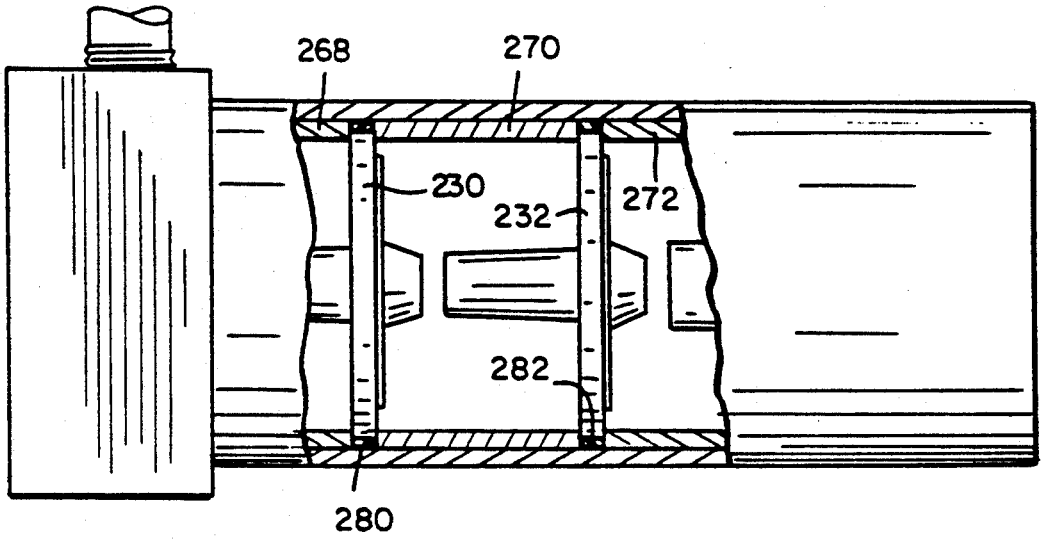
FIG. 7 illustrates a partly broken away side elevational view of another device constructed according to the present invention.

Referring to FIGS. 5 and 7, if air leakage around walls 230, 232 between spacers 268, 270 and 270, 272, respectively, degrades pump performance, O-ring seals 280, 282 can be added around the cimcumferences of walls 230, 232, respectively, to seal them to the inner sidewall of cylinder 262.

Figure 8:
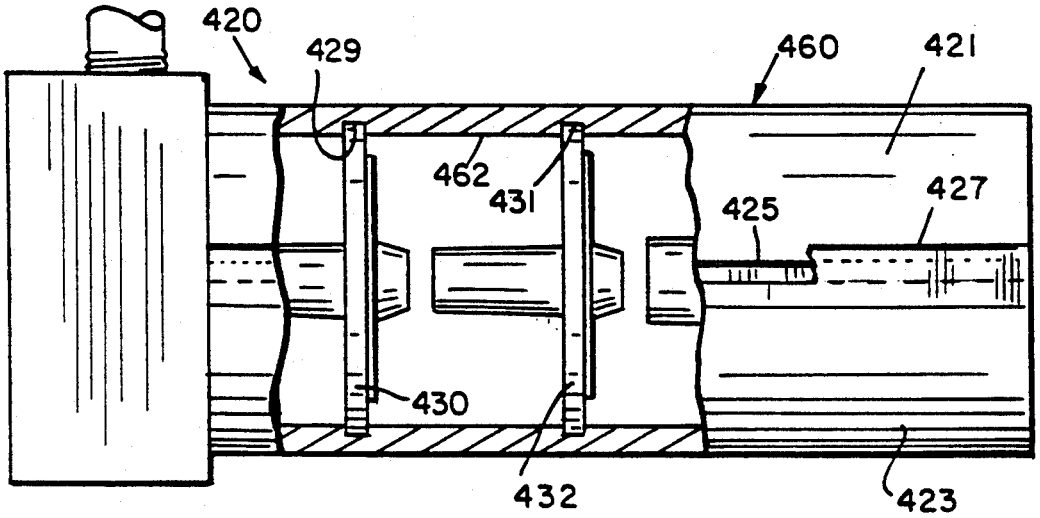
FIG. 8 illustrates a partly broken away side elevational view of another device constructed according to the present invention.
Figure 9:
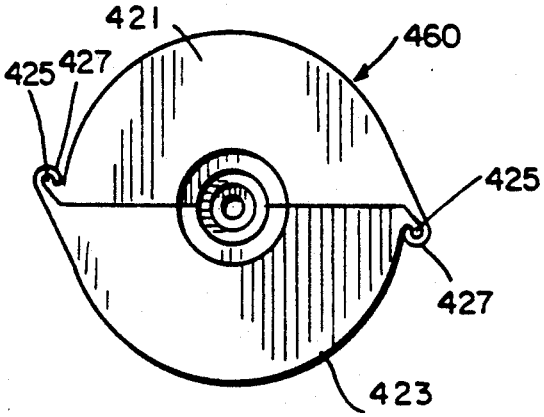
FIG. 9 illustrates a fragmentary end view of the device illustrated in FIG. 8, taken generally along section lines 9—9 of FIG. 8.

In the embodiment of the invention illustrated in FIGS. 8-9, the pump body 460 is provided by a pair of generally hemicylindrical housing sections 421, 423, each of which is provided with two complementarily configured locking edges 425, 427. The inner sidewall of a right circular cylinder 462 of generally uniform cross section all along its length is provided by the assembled sections 421, 423. Cylinder 462 is Provided with annular grooves 429, 431 respectively. Grooves 429, 431 capture the perimeters of walls 430, 432, respectively, of pump 420.

Figure 10:
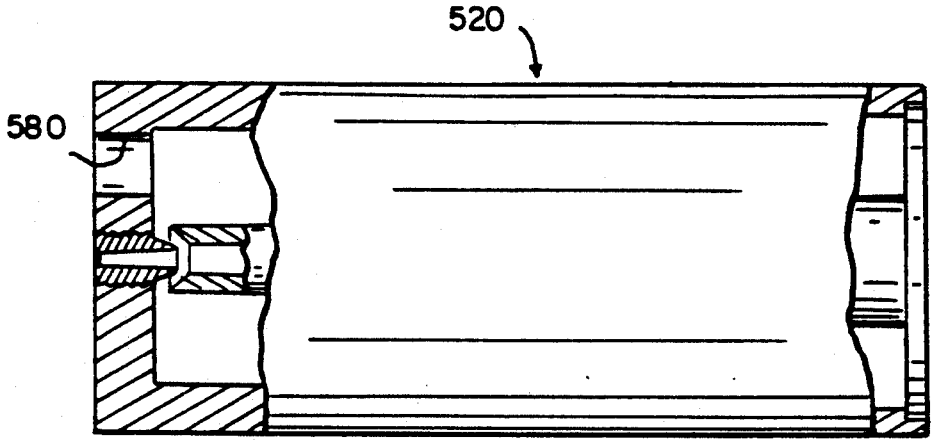
FIG. 10 illustrates a party broken away side elevational view of a device constructed according to the present invention.

The pump 20 can include a manifold 28 as illustrated in FIGS. 1-2 for providing access to compressed air and the vacuum generated by the pump. Alternatively, the pump 520 can simply be plumbed to a compressed air source and plumbed for access to its vacuum port 580, as illustrated in FIG. 10.

Figure 11:
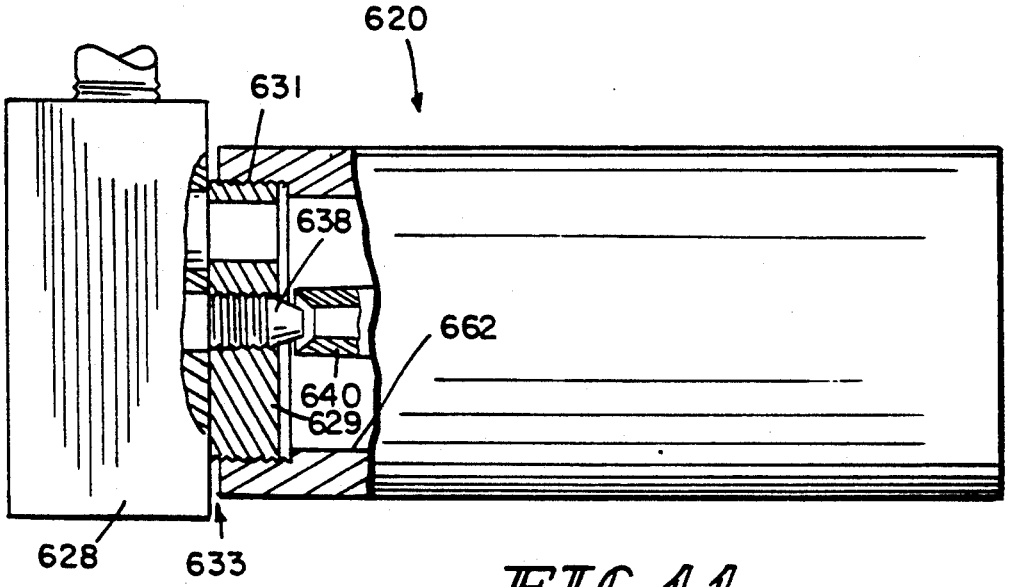
FIG. 11 illustrates a partly broken away side elevational view of a device constructed according to the present invention.
Figure 12:
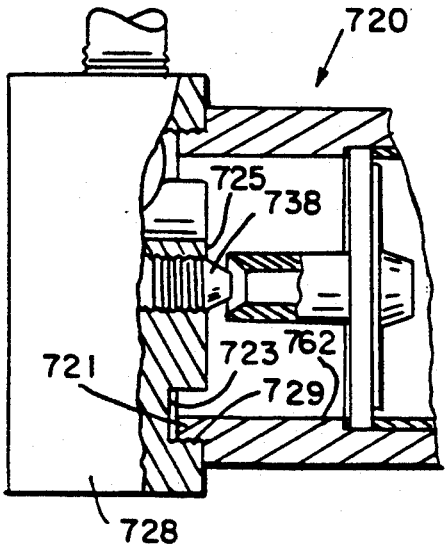
FIG. 12 illustrates a fragmentary, partly broken away side elevational view of a device constructed according to the present invention.

In mounting a pump from a manifold, different techniques can be employed, two of which are illustrated in FIGS. 11 and 12. In FIG. 11, a pump 620 includes a plate 629 which is attached to a manifold 628 by screws or bolts, not shown, which extend through the manifold 628 and into or through the plate 629. The high pressure nozzle 638 is threaded into plate 629. Plate 629 is circular in elevation, and its perimeter 631 is threaded. Mating threads are provided on the inner surface of the pump 620 cylinder 662. Cylinder 662 is screwed onto manifold 628. This mounting arrangement also provides for some adjustment of the spacing between the adjacent surfaces of nozzles 638, 640 by which pump 620 performance can be optimized. Shims, washers and/or elastomeric seals providing different spacings between nozzles 638, 640 can be provided for the space 633 between manifold 628 and cylinder 662, as desired.

In the embodiment illustrated in FIG. 12, a pump 720 includes a cylinder 762 provided with a threaded annular lip 721 which protrudes axially from its high magnitude vacuum end. The manifold 728 in this embodiment is provided with an annular recess 723 on its face 725. The radially outer wall of recess 723 is threaded as at 729. After the high pressure nozzle 738 is screwed into manifold 728, cylinder 762 can be screwed onto manifold 728 by engaging threads 729 with the threads on lip 721.

Figure 13:
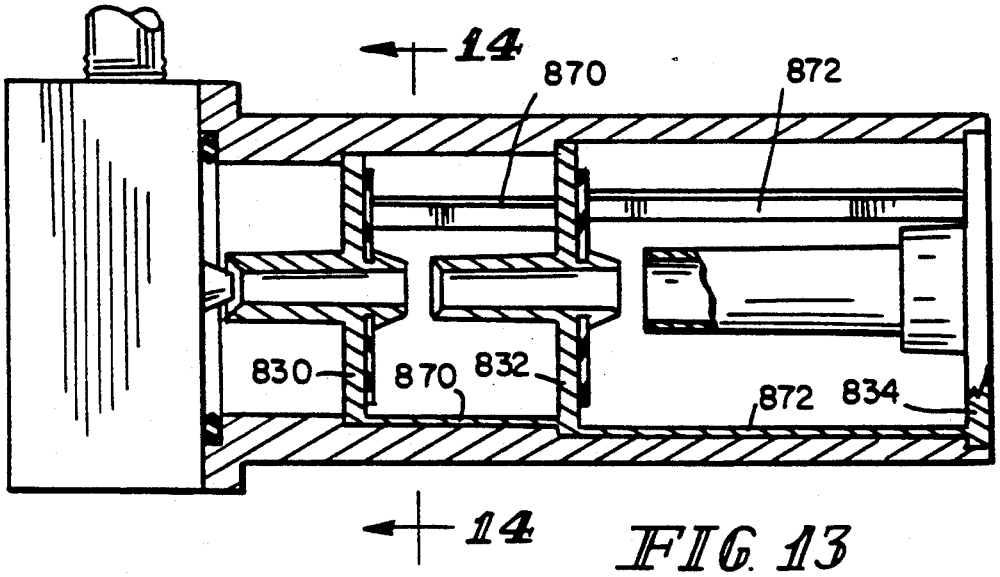
FIG. 13 illustrates a partly fragmentary, partly longitudinal sectional side elevational view of a device constructed according to the invention.
Figure 14:
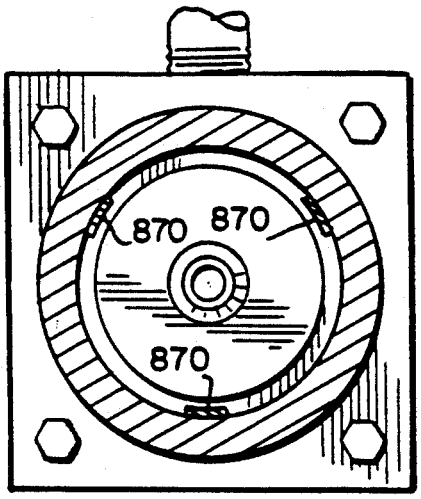
FIG. 14 illustrates a fragmentary sectional view of the device of FIG. 13, taken generally along section lines 14—14 of FIG. 13.

In the embodiment illustrated in FIGS. 13-14, the sleeve-like spacers such as spacers 70, 72 of the embodiment of FIGS. 1-3 are replaced by spacer ribs or legs 870, 872 which extend between adjacent walls 830, 832 and 832, 834, respectively. While walls 830, 832, 834 and legs 870, 872 are illustrated as a single element, it should be understood that legs 870 can be formed with wall 830 and legs 872 can be formed with wall 832. Alternatively, legs 870 can be formed with wall 832, and legs 872 can be formed with wall 834. In another alternative construction, legs 870 and 872 can be formed with wall 832.

Figure 15:
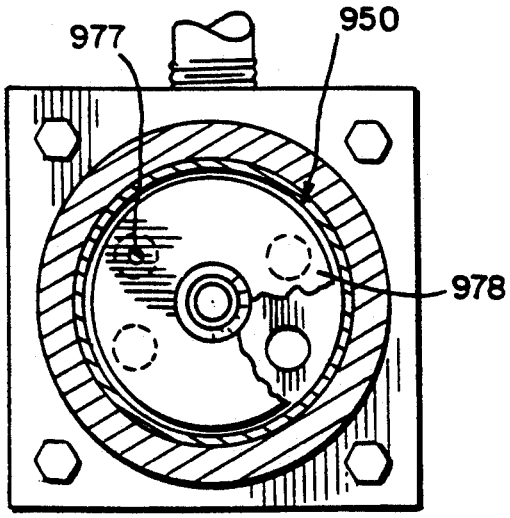
FIG. 15 illustrates an alternative detail to details illustrated in FIGS. 2 and 14.

Under certain circumstances, it may be desirable to control the maximum magnitude of the vacuum differential that can exist between adjacent chambers of pumps of the type illustrated and described herein. One simple technique for effecting vacuum differential control is illustrated in FIG. 15. As illustrated in FIG. 15, a small vacuum bleed hole 977 is provided in the elastomeric valve disk 978 of the one-way valve 950 between two adjacent chambers.

Figure 16:
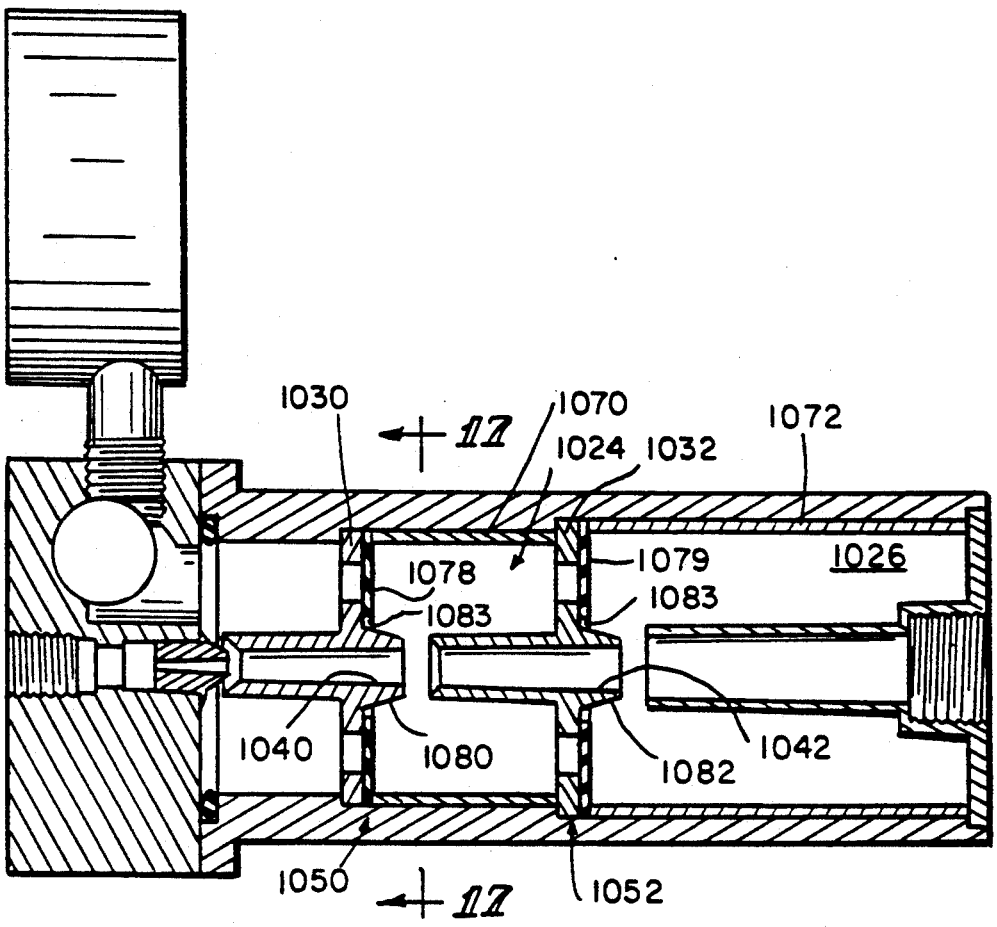
FIG. 16 illustrates a longitudinal sectional side elevational view of a device constructed according to the invention.
Figure 17:
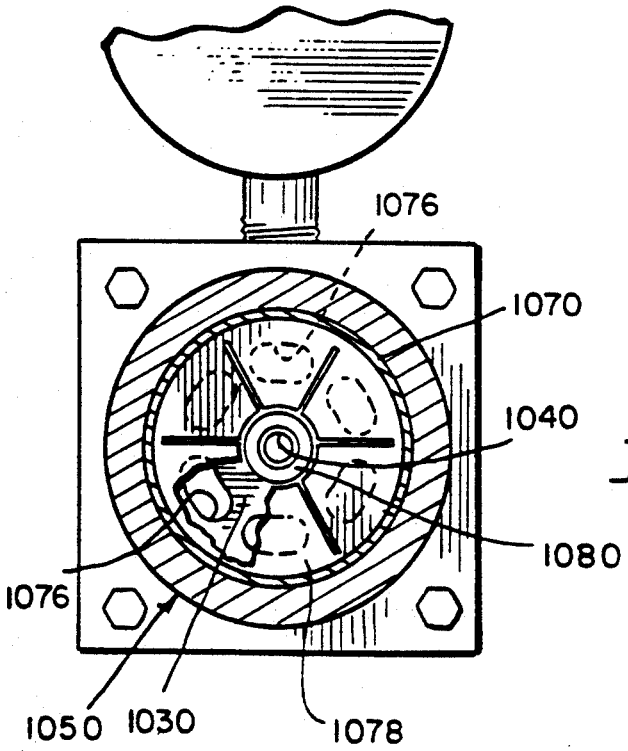
FIG. 17 illustrates a fragmentary sectional view of the device of FIG. 16 taken generally along section lines 17—17 of FIG. 16.

Referring to FIG. 16-17 an alternative one-way valve construction is illustrated. The elastomeric disks 1078, 1079 in the embodiment of FIGS. 16-17 are fixed at their outer perimeters by capturing them between the adjacent surfaces of their respective walls 1030, 1032, respectively and cylindrical spacers 1070, 1072, respectively. As best illustrated in FIG. 17, each disk 1078, 1079 has a central aperture 1083 somewhat larger than the portion 1080, 1082 of its respective nozzle 1040, 1042 which protrudes from its respective wall 1030, 1032 into the next adjacent downstream chamber 1024, 1026, respectively. Each disk 1078, 1079, is also radially slitted outwardly from its central aperture 1083 to enhance the operation of its respective one-way valve 1050, 1052.

What is claimed is:

1. In an ejector pump comprising a plurality of longitudinally aligned chambers, each including a pair of opposed end walls, at least two of said walls including a nozzle and a one-way valve, and means for supplying compressed gas to the most upstream of the nozzles, the improvement wherein the pump comprises a single cylindrical pump body defining a cylinder will multiple said walls inserted therein, each wall having substantially the shape of a cross section through the cylinder at a point along the length of the cylinder to which said wall is inserted, and cylindrical spacer sleeves, each having an outer cross section substantially identical to the cross-section of the cylinder to be received therein for securing each wall at its respective point along the length of the cylinder.

2. The apparatus of claim wherein the cylinder is a circular cylinder and the walls are circular.

3. The apparatus of claim 2 wherein the nozzles are oriented in the centers of their respective walls.

4. The apparatus of claim 1, 2 or 3 wherein the one-way valves comprise disks of elastomeric material, each provided with an aperture for accommodating the nozzle provided in its respective wall, each one-way valve further comprising one or more valve openings covered by a respective one of the disks.

5. The apparatus of claim 1, 2 or 3 wherein each wall includes a perimeter and further comprising an O-ring seal for positioning around the perimeter of each wall.

6. In an ejector pump comprising a plurality of longitudinally aligned chambers, each including a pair of opposed end walls, at least two of said walls including a nozzle and a one-way valve, and means for supplying compressed gas to the most upstream of the nozzles, the improvement wherein the pump comprises a single cylindrical pump body with multiple said walls inserted therein defining a plurality of axially aligned cylinders each of which lies in open communication with an adjacent one of said cylinders, with the cross-sections of the cylinders being similar and the cross-section of each such cylinder being greater than the cross-section of the next adjacent downstream cylinder, each wall having substantially the shape of a cross-section through one of said cylinders, and means defining grooves in the cylinders adjacent each respective point and snap rings for positioning in the grooves for securing each wall in one of said cylinders.

7. The apparatus of claim 6 wherein the cylinders are circular cylinders and the walls are circular.

8. The apparatus of claim 7 wherein the nozzles are oriented in the centers of their respective walls.

9. The apparatus of claim 6, 7 or 8 wherein each wall includes a perimeter and further comprising an O-ring seal for positioning around the perimeter of each wall.

10. The apparatus of claim 6, 7 or 8 wherein the one-way valves comprise disks of elastomeric material, each provided with an aperture for accommodating the nozzle provided in its respective wall, each one-way valve further comprising one or more valve openings covered by a respective one of the disks.

11. In an ejector pump comprising a plurality of longitudinally aligned chambers, each including a pair of opposed end walls, at least two of said walls including a nozzle and a one-way valve, and means for supplying compressed gas to the most upstream of the nozzles, the improvement wherein the pump comprises a single cylindrical pump body with multiple said walls inserted therein defining a plurality of axially aligned cylinders each of which lies in open communication with an adjacent one of said cylinders, with the cross-sections of the cylinders being similar and the cross-section of each such cylinder being less than the cross-section of the next adjacent downstream cylinder, each wall having substantially the shape of a cross-section through one of said cylinders, and means defining grooves in the cylinders adjacent each respective point and snap rings for positioning in the grooves for securing each wall in one of said cylinders.

12. The apparatus of claim 1 wherein the cylinders are circular cylinders and the walls are circular.

13. The apparatus of claim 12 wherein the nozzles are oriented in the centers of their respective walls.

14. The apparatus of claim 11, 12, or 13 wherein each wall includes a perimeter and further comprising an O-ring seal for positioning around the perimeter of each wall.

15. The apparatus of claim 11, 12 or 13 wherein the one-way valves comprise disks of elastomeric material, each provided with an aperture for accommodating the nozzle provided in its respective wall, each one-way valve further comprising one or more valve openings covered by a respective one of the disks.

* * * * *